United States Patent [19]

Austin

[11] 4,443,897

[45] Apr. 24, 1984

[54] ANTI-CLOG SINK DEVICE

[76] Inventor: Anderson Austin, 2654 Broward Rd., Jacksonville, Fla. 32218

[21] Appl. No.: 398,661

[22] Filed: Jul. 15, 1982

[51] Int. Cl.[3] ..... E03C 1/26

[52] U.S. Cl. ..... 4/291

[58] Field of Search ..... 4/286–292, 4/652; 210/238, 470, 478, 479, 482

[56] References Cited

U.S. PATENT DOCUMENTS

| | | | |
|---|---|---|---|
| 412,195 | 10/1889 | Marker | 4/289 |
| 1,116,544 | 11/1914 | Barker | 4/291 |
| 1,442,361 | 1/1923 | Renholdt | 4/652 |
| 1,560,471 | 11/1925 | Horne | 210/482 |
| 1,715,601 | 6/1929 | Horne | 210/482 |
| 1,734,995 | 11/1929 | Brown | 210/482 |
| 2,747,739 | 5/1956 | Bissonnette et al. | 210/482 |
| 3,651,947 | 3/1972 | Schollhamer | 210/478 X |

FOREIGN PATENT DOCUMENTS

| | | | |
|---|---|---|---|
| 46743 | 3/1982 | European Pat. Off. | 4/197 |
| 2057865 | 4/1981 | United Kingdom | 4/290 |

*Primary Examiner*—Charles E. Phillips

*Attorney, Agent, or Firm*—Auslander and Thomas

[57] ABSTRACT

An anti-clog sink device is provided which comprises a cylindrical support piece, a screen, an elastic retainer, a detent, and a handle. The cylindrical support piece is open at one end and has teeth attached, which are located in a plane perpendicular to the cylinder axis and disposed at the second end of the cylindrical support piece, said teeth being directed to about the axis of the cylindrical support piece. The screen has a circular bottom to be seated on the teeth of the cylindrical support piece and a cylindrical rim adapted to fit into the cylindrical support piece adjacent to its inner surface. The elastic retainer is adapted to be placed inside of the cylindrical rim of the screen to retain the screen tightly in position relative to the cylindrical support piece. The detent is attached to the inside of the cylindrical support piece for preventing the elastic retainer and the screen from falling out of the cylindrical support piece at its open side. The handle is from metal and has a size adapted to the diameter of the cylindrical support piece and has ends to fit into bore holes disposed at diametral positions of the cylindrical piece with respect to the cylinder axis.

1 Claim, 3 Drawing Figures

ANTI-CLOG SINK DEVICE

BACKGROUND OF THE INVENTION

1. Field of the Invention

The present invention relates to an anti-clog sink device for straining liquids being disposed of in a sink and for separating and preventing the solids contained in the liquid and having a size above a certain diameter to pass through.

2. Brief Description of the Background of the Invention Including Prior Art

Sink anti-clog devices have been taught in the past. J. C. McKim in U.S. Pat. No. 948,900 teaches a strainer for wash basins. The strainer employs a sieve of fine wire with an outer rim and seated in a simple holder.

H. M. Murphy in U.S. Pat. No. 1,592,866 teaches an auxiliary sink strainer with a perforated strainer plate which is held in place by the usual spring fingers. A conical strainer is taught by E. C. Bruen in U.S. Pat. No. 369,980 having a removable auxiliary bottom. A strainer with a perforated wall and bottom is taught by Vinocor in U.S. Pat. No. 2,695,411. A hair strainer is taught by Ballentine in U.S. Pat. No. 3,742,524, where a hollow cylinder formed of mesh with a closed bottom end and open at its top fits detachably into a drain opening. Bruning in U.S. Pat. No. 3,788,485 discloses a drain guard for contact lens employing a ring fabricated of rubber or plastic and a mesh net, which does extend across the ring opening and which is bonded to or formed unitarily with the ring.

Only some of the above strainers employ wire mesh, but of those references which do, there is in general provided that the wire mesh be bonded to some retaining or reinforcing ring. This in general limits for practical purposes the kinds and sizes of wire mesh which can be employed, since they have to be obtained together with the reinforcing configuration. In addition, the structure comprising the wire mesh as taught in the art may be quite weak.

OBJECTS AND SUMMARY OF THE INVENTION

Accordingly, it is an object of the invention to provide an anti-clog sink device which is easily adaptable to various requirements regarding the screen, which separates the solids from the liquids.

Is is a further object of the invention to provide an anti-clog sink device which can be easily assembled and disassembled without the use of tools and which can be easily inserted and removed.

It is another object of the invention to provide an anti-clog sink device which is recessed below the lower inner surface of the sink and which allows flow of liquid through the full diameter of the screen.

Furthermore, it is an object of the invention to provide an anti-clog sink device, which can be easily handled and which is easy to clean.

According to one aspect of the invention there is provided an anti-clog sink device which comprises a support member open at one end and having teeth attached, which are located in a plane perpendicular to the cylindrical axis of the support member and disposed at the second end of the support member, said teeth being directed to about the axis of the cylindrical section, a screen having a circular bottom portion to be seated on the teeth of the support member and a rim adapted to fit into the support member adjacent to its inner surface, an elastic retainer ring adapted to be placed inside of the rim of the screen to retain the screen tightly in position relative to the support member, a bridging member attached to the inside of the support member for preventing the elastic retainer ring and the screen from falling out of the support member at its open side, and a handle from metal having a size adapted to the diameter of the support member and having ends to fit into bore holes disposed at diametral positions of the support member with respect to the cylinder axis.

The support member can have a seam parallel to the cylinder axis, where it is held together by being attached on each side of the seam by a bridging member by way of pins. The handle can form substantially a semicircle, where the radius of the semicircle of the handle is slightly less than the radius of the support means such that the handle can rest on the retainer ring. The teeth can have tips directed to the center axis of the cylinder. The support member can be from aluminum and can have a thickness of from about 0.5 millimeter to 2 millimeter. The support member can be from stainless steel having a thickness of from about 0.2 to 1 millimeter. The handle wire preferably has a diameter of from about 2 to 5 millimeters. The retainer ring can be provided as an incomplete circle to allow for mounting and demounting of the screen. The screen can be a wire grid with wire spacings of from about 1 to 3 millimeter.

The anti-clog sink device of the present invention provides the retaining of refuse and undesirable solid wastes and prevents them from passing into the drain line, where they could cause restricting and clogging the line. The serrated screen support area of the support member allows flow through practically the full diameter of the screen. Thus drain line restrictions, clogging and stoppages in the drain line due to retention of solids, semisolids, refuse and undesirable substances which could enter the drain are substantially eliminated. This then eliminates the need for physical insertion of augers, snakes, or similar instruments into the drain line for breaking up of blockages, restrictions and stoppages.

The anti-clog sink device of the present invention can be easily adapted to various sizes and types of screen material. The anti-clog sink device can be easily assembled and disassembled without the use of tools. It is adaptable to various shapes of drain recesses and it is recessed below the inner surface of the sink. Furthermore, it can be easily inserted and removed from the sink drain cavity.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
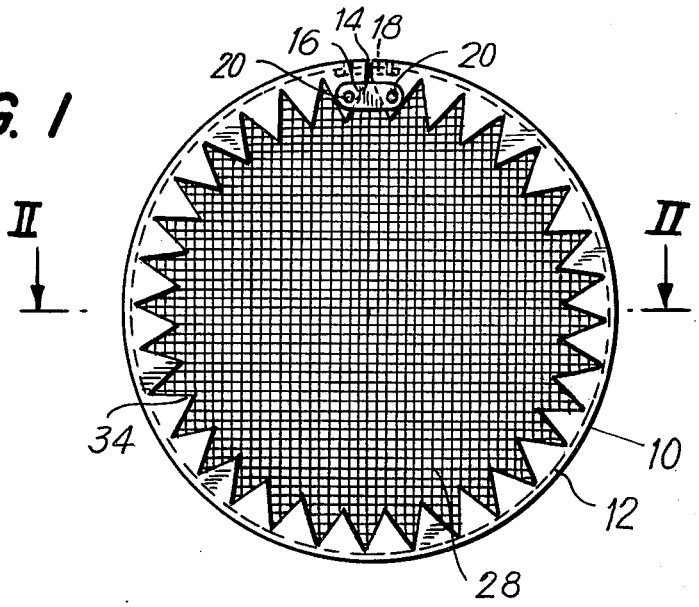
FIG. 1 is a bottom view of the anti-clog sink device with the screen in position.

The anti-clog sink device of the present invention in general comprises the following components: a support member 10, a handle 24, a screen 28, a retainer ring 32 and a bridging member 18.

Figure 2:
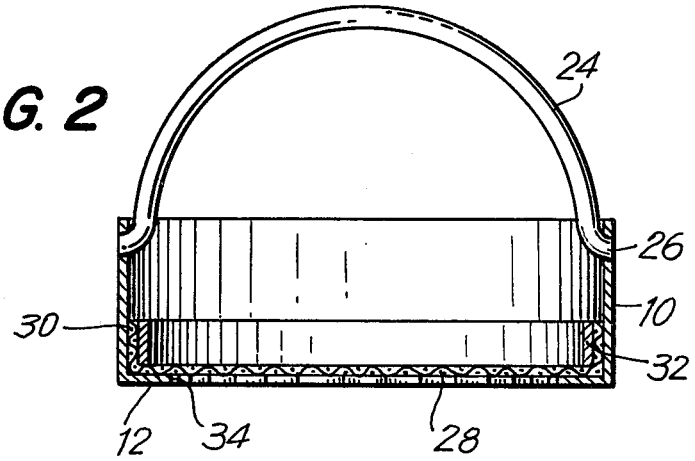
FIG. 2 is a cross-sectional view of the anti-clog sink device of FIG. 1 along section line II—II of FIG. 1.

Referring now to FIG. 1 there is shown a bottom view of the anti-clog sink device of the present invention. A screen 28 is provided for retaining the solids and for passing the liquids from a composite flow. The screen 28 rests along its outer circumference on teeth 12 extending from and attached to the support member 10 (FIG. 2). A bridging member 16 is provided to connect two of the teeth 12 by way of pins 20. The connection is provided as the support member 10 has a seam at one circumferential point, where two ends are joined together to form the cylinder.

Referring now to FIG. 2, there is shown a sectional view of the anti-clog sink device of FIG. 1. The support member 10 is provided with holes through which handle 24 is attached. At the bottom of the support member 10 there are attached teeth 12, which support a screen 28. The teeth 12 as shown have tips 34 directed toward the cylindrical axis. The screen 28 at its outside extends into a rim 30, which is disposed closely contacting the support member 10. The cylindrical part 30 of the screen 28 is pressed against the support member 10 by an elastic retainer ring 32.

Figure 3:
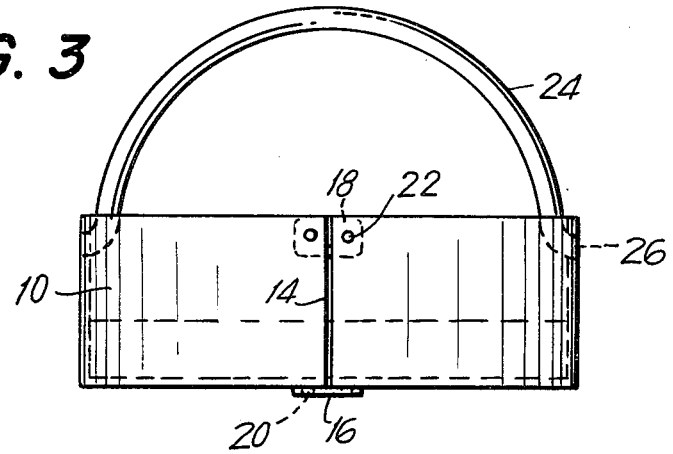
FIG. 3 is a side elevational view of the anti-clog sink device of FIG. 1.

FIG. 3 substantially corresponds to FIG. 2, however it is a side elevational view. The support member 10 has two edges 14 running in parallel to the cylinder axis, which are joined together by the bridging member 18 and by the bridging member 16. The bridging member 18 is attached to the support member 10 by pins 22. The bridging member 16 is attached to two of the teeth 12 attached to the support member 10 by way of two pins 20. The handle 24 is fitted into two bore holes of the support member 10 with its ends 26.

The support member 10 in general is made from a metal such as aluminum or stainless steel. Alternatively, it is possible to produce the support member 10 from plastic, for example by molding. Suitable plastic materials include thermosetting and thermoplastic materials, which are adapted to withstand the chemical composition of the liquids passed through the anti-clog sink device without decomposing or being seriously attacked. A preferred plastic material is polyvinyl chloride. The support member 10 is provided with two holes for engaging the ends 26 of the handle 24. In addition, the support member is provided with teeth 12, which support the screen 28. The length of the teeth 12 in the direction to the cylindrical axis can be from about one twentieth to one fifth of the diameter of the support member 10. The number of the teeth 12 around the circumference of the support member 10 is preferably from about two times to four times the ratio of the diameter of the support member 10 to the length of the teeth 12. While the teeth 12 as shown in FIG. 1 are of triangular shape and have tips 34 pointing to the axis, other shapes are also possible and might be more advantageous. For example trapezoidal shapes of the teeth 12 can be employed and preferably about semicircular shapes of the teeth 12 are employed to avoid the sharp tips 34 occuring with the triangular shape shown in FIG. 2. The teeth 12 in general can be made from the same material as the support member 10. They can be either attached to the support member 10, but preferably they are made from the same piece as the support member 10. They can be cut first and then be bent over or the support member 10 can be formed first with a bottom inner flange and then the teeth 12 can be cut out of the flange.

The thickness of the support member material is preferably from about 0.2 to 1 millimeter if the material employed is stainless steel, from about 0.5 millimeter to 2 millimeter if the material employed is aluminum, and from about 1 millimeter to 4 millimeter, if the material employed is plastic.

The support member 10 is provided with a push fit into the standard drain recesses of sinks, in particular in kitchens. The outer wall of the support member 10 will make light contact with the inner wall of the drain recess. While the anti-clog sink device is usually of circular shape, other shapes such as for example elliptical are also possible, while others such as rectangular are possible, they are not advantageous based on the sharp edges generally associated with rectangular shapes.

The screen 28 generally rests with its circular bottom portion on the inner serrated surface attached to the support member 10 and the rim 30 fits adjacent to and against the lower area of the inner wall of the support member 10. Preferably, the screen 28 is provided with a number of cuts so that it will not pucker when placed within the support member 10. Alternatively, the screen 28 can be pressed so that it fits into the space provided within the support member 10. The screen 28 can be made from a variety of materials forming a grid, which are preferably metals including copper, brass, aluminum, stainless steel and related alloys providing a wire grid. Alternatively, the screen 28 can be made from plastic material.

The retainer ring 32 is provided to hold the screen 28 in position by way of the elastic spring force of the retainer ring 32. In general, the retainer ring 32 will be a narrow cylindrical part, which is cut at one place along a line about parallel to its cylinder axis. Thus the retainer ring 32 is to be made of a material with good spring properties. Materials suitable for the retainer ring 32 include aluminum and steels such as stainless steel. Depending on the stiffness of the material employed it may be desirable to provide the retainer ring 32 not as a simple cylindrical part, but to corrugate it along its outer circumference to reduce the stiffness and to protect it against deformation from the cylindrical symmetry. The retainer ring 32 conforms to the contour of the inner wall of the support member 10 and exerts constant pressure, when in place, against the rim 30 of the screen 28 as the rim 30 of the screen 28 is fitted between retainer 32 and the inner wall of the support member 10.

In the embodiment shown in FIG. 3, the bridging member 18 serves the function of fastening the edges of the support member 10 together at their seam and at the same time to prevent accidental removal of the screen 28 and retainer 32 from the support member 10. The bridging member 18 can be a piece of material attached to the completely open side of the support member 10. In general, the material will be of the same kind as the support member 10 and it will be following the inner wall of the support member where it is affixed to the inner wall. The position of the bridging member 18 is such as to prevent the retainer 32 from being forced out of the support member 10 when the anti-clog sink device is inverted and for example tapped against a surface to remove refuse from the screen 28.

The handle 24 is provided to allow easy handling of the anti-clog sink device. At the same time, a close fit of the handle 24 can provide additional strength to the support member 10. It is preferably made from a fairly stiff metal wire, which is capable of retaining its shape.

It is inserted with its ends 26 into two diametrically disposed holes in the upper wall of the support member 10 in a close fit. It is of semicircular shape and provides a secondary means for preventing the dislodging of the retainer 32 and screen 28 from the support member 10 when it is inverted or tapped against a firm surface for cleaning.

The anti-clog sink device of the present invention can be disassembled by holding the assembled anti-clog sink device in an upright position with the handle near vertical. The handle 24 is grasped near the points of entry into the holes of the support member 10 and is squeezed lightly inward until the handle ends 26 clear the holes thereby facilitating the removal of the handle 24 from the support member 10. Then one end of the retainer ring 32 is grasped and pulled lightly inward away from the vertical part 30 of the screen and the inner wall of the support member 10. Now the retainer 32 is pulled upward and out of the support member 10. The unsecured screen 28 can thus be lifted from the lower serrated area of the support member 10 of the anti-clog drain device. Reassembly is performed by reversing the steps set forth.

The anti-clog sink device can be used by removing for example a basket type strainer or other implement from the sink drain cavity and by pushing the anti-clog sink device to the bottom of the sink drain cavity, where all the solid refuse placed in the sink will be prevented from passing into the drain line and causing clogging of the same, since the refuse will be retained by the screen 28 of the anti-clog sink device. If the anti-clog drain device is full of refuse or when emptying of the anti-clog sink device is desired, the handle 24 is simply moved to the vertical position and the anti-clog sink device is lifted from the sink drain cavity. Upon inverting the anti-clog sink device and tapping it several times, the refuse will fall from the surface of the screen and the device can be used again by being reinserted into the sink drain cavity.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

I claim:

1. An anti-clog sink device including a support member, said support member having ends, a bridging member, said support member forming a cylindrical shape and having its ends joined by said bridging member, said bridging member secured to said support member by pins, said bridging member having a thickness and disposed inwardly of said cylindrical shape, a plurality of teeth, said teeth narrowing in width inward of said cylindrical shape, and said teeth being integral with one end of said support member and extending inwardly of said cylindrical shape in a plane perpendicular to the cylindrical axis of said support member, said teeth forming a support surface, a screen, said screen adapted to be seated on said support surface, said screen having a diameter greater than the cylindrical shape of said support member, said screen at its outer periphery having a rim at substantially right angles thereto and extending adjacent the inner surface of said support member with said rim adjacent the wall of said support member, a flexible retainer said retainer adapted to tightly fit inwardly of said support member biasing said rim against said support member, said thickness of said bridging member adapted to retain said screen and retaining member from falling free of the open end of said support member, a second bridging member joining the ends of said support member at two adjacent teeth and secured by pins, and a handle; said handle being semi-circular and having a span equal to the diameter of said support member; and said handle removably and rotatably engagable in bore holes in said support member.

* * * * *